United States Patent [19]

Elesh et al.

[11] Patent Number: 4,843,666

[45] Date of Patent: Jul. 4, 1989

[54] PILLOW MATTRESS

[75] Inventors: James N. Elesh, Evanston; Arthur J. Martelli, Naperville, both of Ill.

[73] Assignee: Flexi-Mat Corporation, Chicago, Ill.

[21] Appl. No.: 259,401

[22] Filed: Oct. 18, 1988

Related U.S. Application Data

[63] Continuation-in-part of Ser. No. 18,780, Feb. 27, 1987, abandoned, which is a continuation-in-part of Ser. No. 907,493, Sep. 15, 1986, abandoned.

[51] Int. Cl.[4] ..... A47C 27/00

[52] U.S. Cl. ..... 5/447; 5/462; 5/464; 5/465; 5/468

[58] Field of Search ..... 5/437, 446, 448, 461, 5/462, 464, 465, 468, 470, 481

[56] References Cited

U.S. PATENT DOCUMENTS

| | | | |
|---|---|---|---|
| 380,713 | 4/1888 | Clement | 5/465 |
| 681,573 | 8/1901 | Nichols | 5/465 |
| 754,329 | 3/1904 | Milliken | 5/465 X |
| 931,361 | 8/1909 | Weinberg | 5/465 |
| 1,040,795 | 10/1912 | Skeffington | 5/465 X |
| 1,276,361 | 8/1918 | Hobert | 5/465 |
| 1,423,416 | 7/1922 | Gomes | 5/465 |
| 2,184,808 | 12/1939 | Belian | 5/468 X |
| 2,548,547 | 4/1951 | Melrose | 5/465 |
| 3,191,197 | 6/1965 | Frey | 5/243 |
| 3,451,071 | 6/1969 | Whiteley | 5/465 X |
| 3,731,327 | 5/1973 | Frey | 5/465 X |
| 3,740,774 | 6/1973 | Powell | 5/465 X |
| 3,742,528 | 7/1973 | Munch | 5/464 X |
| 3,950,798 | 4/1976 | Borsini | 5/465 |
| 4,128,272 | 12/1978 | Boyle | 5/465 X |
| 4,139,920 | 2/1979 | Evans | 5/465 X |
| 4,163,297 | 8/1979 | Neumark | 5/465 X |
| 4,256,096 | 3/1981 | Budde | 5/465 X |
| 4,394,783 | 7/1983 | Simmons | 5/437 X |
| 4,394,784 | 7/1983 | Swenson et al. | 4/464 X |
| 4,407,031 | 10/1983 | Michiels | 5/481 X |
| 4,500,396 | 3/1985 | Ritchie, Jr. | 5/437 X |
| 4,628,557 | 12/1986 | Murphy | 5/464 X |
| 4,706,313 | 11/1982 | Murphy | 5/464 |

FOREIGN PATENT DOCUMENTS

| | | | |
|---|---|---|---|
| 2701798 | 7/1978 | Fed. Rep. of Germany . | |
| 2742397 | 3/1979 | Fed. Rep. of Germany . | |
| 2744412 | 4/1979 | Fed. Rep. of Germany | 5/465 |
| 2373306 | 8/1978 | France | 5/420 |
| 325396 | 11/1957 | Switzerland | 5/481 |
| 722867 | 2/1955 | United Kingdom . | |
| 954103 | 5/1964 | United Kingdom . | |
| 1097078 | 12/1967 | United Kingdom . | |
| 1265776 | 3/1972 | United Kingdom . | |
| 1300733 | 12/1972 | United Kingdom . | |
| 1391506 | 4/1975 | United Kingdom | 5/465 |
| 1585662 | 3/1981 | United Kingdom . | |
| 212808 | 4/1984 | United Kingdom . | |
| 2177595 | 1/1987 | United Kingdom . | |
| 8101792 | 7/1981 | World Int. Prop. O. | 5/474 |

OTHER PUBLICATIONS

Western Medical Series 800 Low Pressure Fluid Support Systems for Prevention of Healing of Pressure Sores.

Hoover Universal, "Join the Air Force."

AKROS Decubitus Prevention/Treatment Systems.

OBA "Super-Soft".

OBA Lagerungsmoglichkeiten Differentes Possibilities de Positions.

*Primary Examiner*—Gary L. Smith

*Assistant Examiner*—Michael F. Trettel

*Attorney, Agent, or Firm*—Laff, Whitesel, Conte & Saret

[57] ABSTRACT

A mattress designed to prevent bedsores is made from an open foamed plastic box enclosing pillows filled with stuffing in a cushion cavity. This construction is enclosed in a zippered mattress cover, which may be waterproof. The pillows can be separate or joined together to form a compartmentalized pillow cushion. The pillow cushion can be made from a pillow bag stuffed with textile fiber or foamed plastic particles and divided into compartments by seams. Separately formed pillows may be left loose within the cushion cavity, or detachably joined together. The mattress can have pillows of different density stuffing or sizes the seams being transverse and compartmentalizing the pillow bag; and reclosable closure means in at least one of the seams for easily reopening and reclosing it, whereby the stuffing in the compartment accessed by the closure means may be adjusted.

10 Claims, 2 Drawing Sheets

PILLOW MATTRESS

This application is a continuation-in-part of application Ser. No. 07/018,780, filed Feb. 27, 1987, now abandoned, which was a continuation-in-part of application Ser. No. 06/907,493, filed on Sept. 15, 1986 now abandoned.

BACKGROUND

This invention relates to mattress, and more particularly to mattresses having means for adjusting the points and quantity of body support. The manner in which a patient's body is supported on a mattress can be very significant for preventing bedsores in bedridden patients. Normally when a person is at rest on a mattress, or asleep, there is a certain amount of natural body movement. This movement helps ensure that the skin at those parts of the body receiving the most pressure from the mattress, usually the bony protuberances, it not subject to excessive pressure over time. Unfortunately, many bedridden patients cannot move about on the bed sufficiently to avoid a constant pressure on these bony protuberances. The pressure can partially or totally block the skin capillaries, causing the cells to atrophy. This results in chronic bedsores, or what is medically called "decubitus". Aside from bedsores, which generally occur only with seriously ill, bedridden person, there is another problem which affects nearly everyone at one time or another. According to the *New York Times* (July 10, 1985 edition), 75 million people have been afflicted with back problems; 2 million people are chronically in pain and 8 million new cases occur each year. Back problems occur for a variety of reasons, including mattresses that do not offer proper support. Even when a mattress is not the initial cause of a backache, a mattress can aggravate or at least increase the discomfort of a backache because too much support, or insufficient support, are provided at particular points of the body. For example, a mattress which is designed to support a body evenly from head to foot will eventually, over time, develop a "soft spot" where the buttocks normally rest. This causes the back vertebrae to oriented in a position which in many people, will cause an irritation in the surrounding tissue and a backache. While many experts recommend a firm mattress to avoid or help backache (even to the point of inserting a wooden board beneath the mattress to increase firmness) (*BC Cycle*), Aug. 1, 1985 edition) others believe that a hard mattress has no therapeutic value and may even create morning backache (*The Washing Post,* June 17, 1983 edition). Thus there is no uniform opinion concerning the proper firmness of a mattress for purposes of alleviating ordinary back pain. Regarding bedsores careful attention and nursing, such as frequent rearrangement of the patient and bedclothes, can reduce this problem somewhat. The bedsores problem still remain largely unsolvent, and very little has been done to improve mattresses for otherwise healthy persons who suffer backache or other body pain which is exacerbated by a mattress.

A variety of special mattress structures and geometries have been proposed, primarily directed at the bedsores problem. For example, distribute mattress pressure more evenly, a water filled mattress supported by a heavy duty steel frame has been used. But such a water bed is exceptionally heavy and requires a heater to compensate for the water's convective cooling effect.

Another device employs an air mattress core enclosed in a foam rubber box and uses an air compressor controllable by the user to vary the air pressure, and hence the firmness of the mattress. But such a system is complex and expensive and cannot easily alter the relative mattress pressure at any one point compared to the mattress as a whole. Another approach uses a layer of juxtaposed cells, each of which contains permanently sealed fluid-gel, covered by foam layers and a plastic sheathing. But while this fluid-gel flotation system reduces some pressure, it does not necessarily have the desired softness and air ventilation, and such special foam and fluid-gel cushions are expensive to manufacture.

Yet another approach is to make a three-piece mattress from foam blocks of different densities that can be placed adjacent to each other like building blocks to form the mattress. If desired, further bed cushions can be piled on top of this. But this is a clumsy arrangement without an integrating structure to simplify handling of the mattress as a whole.

An object of this invention is to provide a new and improved mattress for the reduction and prevention of bedsores and to alleviate discomfort for persons suffering from backache or other body pain. Another object is to provide a simple and inexpensive mattress structure that is easy to assemble, clean, and maintain. Yet another object is to provide such a mattress in a manner that allows easy and inexpensive "customizing" of the mattress configuration and characteristics to meet the needs of different persons, or the same person at different times, according to size, weight, and medical condition.

BRIEF SUMMARY OF THE INVENTION

In keeping with one aspect of this invention, a mattress cushion cavity is made from an open box of firm, resilient material and filled with stuffed pillows forming a pillow cushion. A mattress cover, which may be waterproof, encloses the resulting composite mattress. The pillows forming the pillow cushion can be separate or integrally joined together to form a convenient compartmentalized pillow cushion or cushion module. The pillow cushion can be made from a pillow bag filled with fiber or foam stuffing divided into compartments by seams. The invention includes customizing embodiments where some pillows have a different and adjustable density stuffing or size from the rest. The individual pillows may be joined together with hook and loop type fasteners or other attaching means.

BRIEF DESCRIPTION OF THE DRAWINGS

The above mentioned and other features of this invention and the manner of obtaining them will become more apparent and the invention itself will be best understood by reference to the following description of embodiments of the invention taken in conjunction with the accompanying drawings, in which.

DESCRIPTION OF THE PREFERRED EMBODIMENTS

Figure 1:
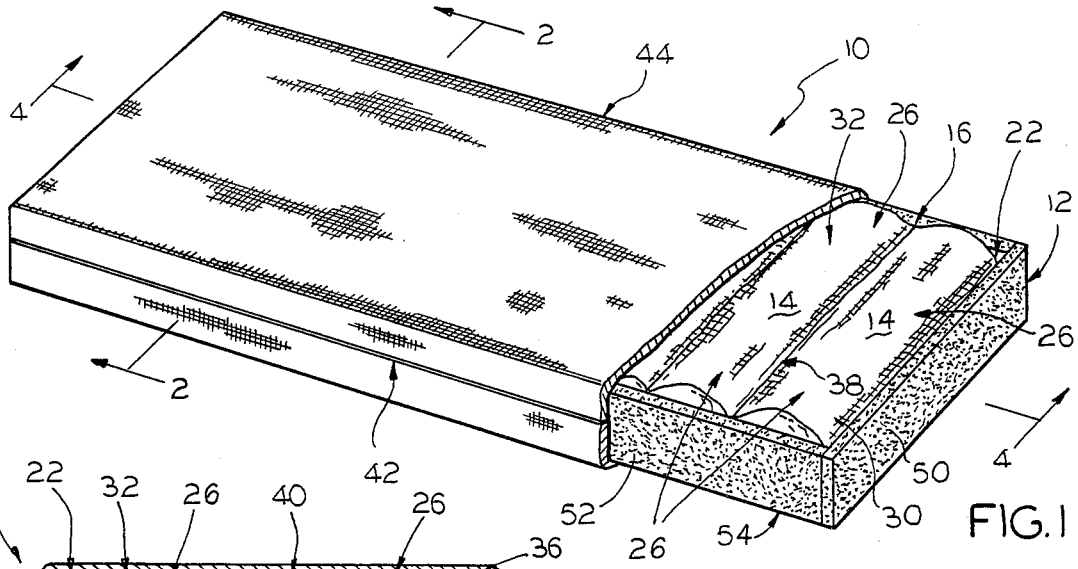
FIG. 1 is a perspective view of a mattress embodying the invention, showing a portion of the mattress cover cut away to reveal an inner construction.
Figure 2:
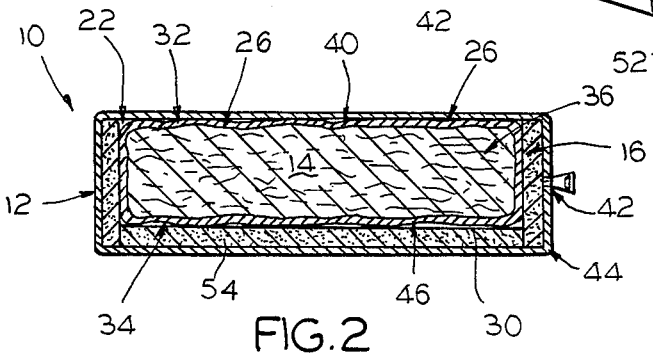
FIG. 2 is a lateral cross section of the mattress taken along 2—2 of FIG. 1.

As shown in FIG. 1, a composite mattress 10 comprises a hollow resilient protective box 12 filled with a set of mattress pillows 14 forming a composite mattress pillow cushion 16, and a cover or tick 44. The set of pillows 14 may be permanently joined together to form a compartmentalized version of pillow cushion 16, shown as cushion module 18, composed of pillow compartments 19. The protective box 12 is dimensioned to externally be the same size as a standard mattress, 35 inches by 80 inches, so the composite mattress 10 can fit on a standard bed frame (not shown).

Figure 3:
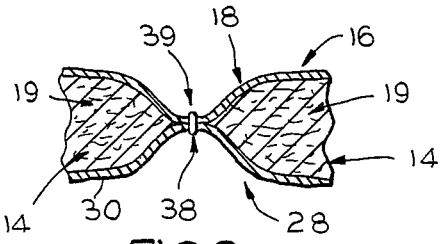
FIG. 3 is an enlarged partial transverse cross section of the mattress showing a seam between two pillow compartments.
Figure 4:
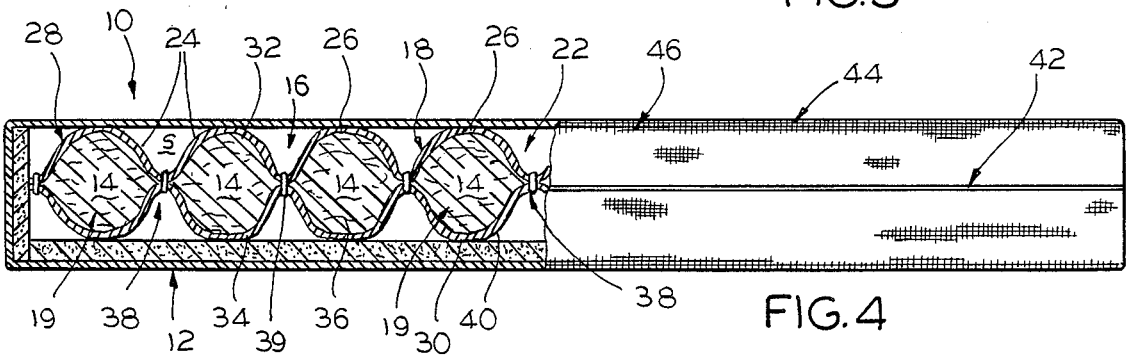
FIG. 4 is a transverse cross section of the mattress taken along 4—4 of FIG. 1.

As shown in FIGS. 3 and 4, the protective box 12 is preferably formed of a firm but resilient material having a thickness of several inches, preferably about two to four inches. The box 12 has an upward facing cushion cavity 22 formed between the four walls and above the floor of box 12, for receiving the pillow cushion 16. It may be made of a foamed plastic, such as polyurethane foam, having a spongy cellular structure. If a waterproof protective box 12 is desired, the foamed plastic can be of the closed cell type, such as closed cell polyurethane or neoprene foam. If waterproofing is not needed, an open cell variety can be used, such as open cell polyurethane foam.

Figure 5:
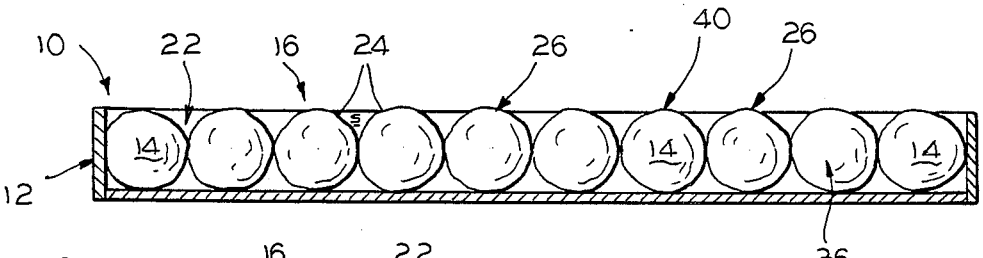
FIG. 5 is a diagrammatic cross section of another embodiment of the invention.

The composite pillow cushion 16 cushion module 18 is stuffed within the box 12 to substantially fill up the box's cushion cavity 22 to provide a generally horizontal composite cushioning mattress surface substantially comprising the upper faces 26 of the pillows 14 or pillow compartments 19. As best shown in FIGS. 4 and 5, the upper faces 26 of each pillow or pillow compartment include at least two inclined or sloped surfaces 24. The inclined surfaces 24 of adjacent pillows 14 or pillow compartments 19 define a trough-shaped space S between them, so that a person resting on the mattress lies over an alternating series of pillows and spaces. In the case where the pillows 14 are permanently joined together as pillow compartments 19, there is only a single compartmentalized pillow cushion 18 to handle, adjust, clean and store.

Figure 6:
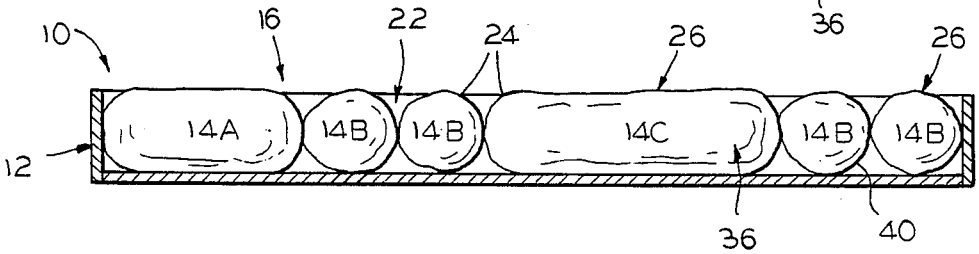
FIG. 6 is a diagrammatic cross section of yet another embodiment of the invention.

On the other hand, as shown by the embodiments of FIGS. 5 and 6 and as will be explained below, the particular size, density, and dimensions of each pillow 14 or compartment 19 in the set can be selected at the time of construction, or later adjusted if desired, to accommodate the general size, weight, and medical condition of the type of patient who will use the bed.

In one embodiment, best shown in FIGS. 3 and 4, the pillows 14 are integrally formed into adjoined set 18 from a compartmentalized fabric pillow bag 30. This is convenient and enables the mattress' firmness and shape to be easily altered by removing the entire cushion module 18 and replacing it with another or auxiliary one of different composition.

The compartmentalized pillow cushion 18 is preferably made from a fabric pillow bag 30 having front 32 and back 34 ticking sheets filled with a suitable stuffing 36. The bag 30 is divided into the desired number of pillows compartments 19 by a suitable corresponding number of seams 38 joining the bag's front 32 and back 34 sheets along lines separating the pillow compartments 19.

The seams 38 can be made by stitching, riveting, heating sealing or the like and preferably are transverse seams 38 that compartmentalize the pillow bag 30. To permit removal or adjustment of the stuffing, some or all of the seam portions can be made with a closure means 39 that can easily be reopened and then closed by the user when desired, such as zippers of various types, VELCRO (TM) or similar hook and loop type fasteners, or snaps (not shown).

The top 32 and bottom 34 cloth sheets of the pillow bag 30 are of a durable ticking fabric 40, which may be a washable fabric. For example, the fabric 40 can be a tightly woven nylon or polyester cloth, or a blend of these with natural fibers.

However, in many applications, such as hospital use, a waterproofed pillow cushion 16 will be desireable. In this case, the ticking fabric 40 of the pillow bag 30 can be one coated with a water repellent, such as water repellent urethane. It is also possible to provide for both washable and waterproofed use as desired by using a washable fabric as the bottom sheet 34 forming the pillow bag 30 and a waterproofed fabric as the top sheet 32.

A particularly suitable ticking material 40, which is also fire retardant, is described in my U.S. Pat. No. 4,525,409 (Elesh). If made of such a fabric, the pillow bag 30 will not require laundering, and will be waterproof and stain resistant. Such fabric is available commercially from Flexi-Mat Corporation of Chicago, Ill.

The stuffing or filling 36 can be any suitable cushioning material, such as garnetted natural or artificial textile fibers, foamed plastic particles, etc., but preferably the stuffing 36 is garnetted polyester fibers or cotton shoddy. Although the same stuffing material 36 may be used for all of the pillows 14, the invention includes the ability to accommodate the size, weight, and medical condition of particular kinds of patients by providing different pillow compartments 19 containing stuffing 36 having different cushioning characteristics.

For example, the amount of stuffing 36 per unit volume may be more for selected pillows, making them firmer or larger than others. The stuffing 36 used in pillow compartment may be different than in another, as where stuffing materials 36 of different densities, or mixtures of materials of different densities are used in different compartments. The stuffing material 36 itself may also be different types, as where one compartment is filled with polyester fiber and another is filled with foamed plastic particles. These variations may result in a cushion 16 having pillows of uniform size, as in FIG. 5, or in a cushion 16 having pillows of different sizes, as in FIG. 6. In FIG. 6, cushions of medium size 14A, small size 14B, and large size 14C are all contained within cavity 22.

Figure 10:
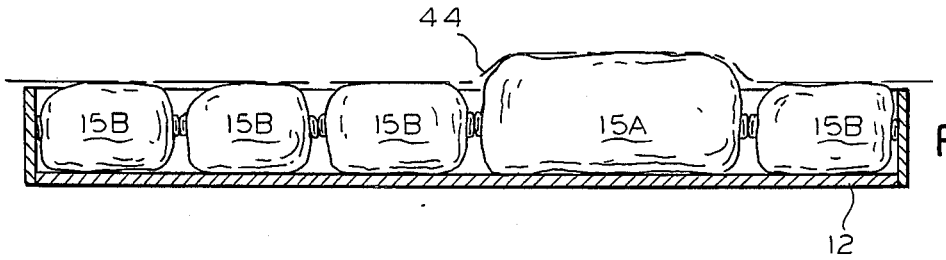
FIG. 10 is a diagrammatic cross section of still another embodiment of invention.

Thus, for example, if the user wishes to sleep on his or her back and elevate the knees above the hips, which is thought by some to be the least stressful position for the back, a relatively large, firm pillow 15A can be positioned below the knees among smaller pillows 15B, as shown in FIG. 10. This produces a non-planar resting or support surface, even when the mattress is positioned within a ordinary bed frame.

In FIGS. 5 and 6, the pillows are shown as loose or separate cells within the mattress, but the same uniformity or variation in size can be achieved with integrally connected pillows sewn into a pillow bag 30.

Figure 7:
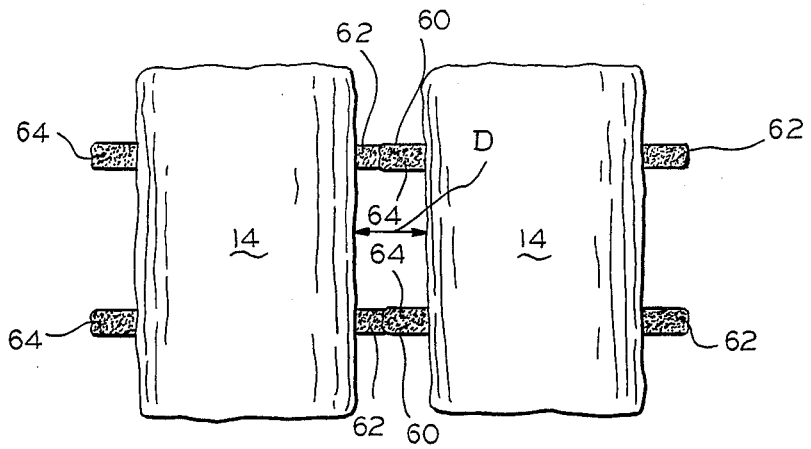
FIG. 7 is a top plan view of pillows having attaching means, according to one embodiment of the invention.
Figure 8:
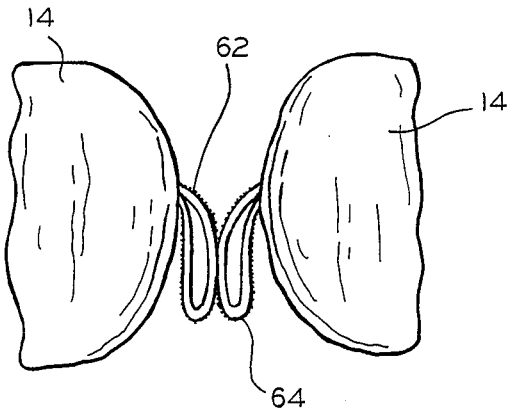
FIG. 8 is a side elevation view of portions of two pillows, according to the embodiment shown in FIG. 7.

In yet another embodiment, the pillows are separately formed but may be joined by attaching means 60, as shown in FIGS. 7 and 8. The attaching means consist of mating belts or flaps 62 and 64 sewn on adjoining portions of the loose pillows 14. The belts 62 have hook type fasteners, such as Velcro, or other attaching means such as snaps, buttons, ties, buckles, or the like. Belts 64 have loop type fasteners, such as Velcro, for adhesion to the hook type fasteners of belts 62, or mating snaps, buttons, ties, buckles or the like. Desirably, each pillow (except the end pillows) is joined to two adjoining pillows. The belts may be positioned inwardly from the corners as shown in the drawings or located at the four corners of each pillow. A preferred number of pillows for this embodiment has been found to be in the range of 6 to 8 pillows, for a twin size mattress.

Figure 9:
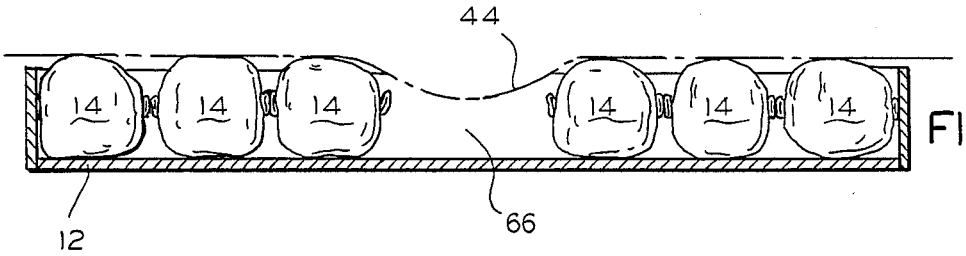
FIG. 9 is a diagrammatic cross section of still another embodiment of the invention.

In this way, the individual pillows will not shift their positions during use, but one or more individual pillows can be detached and removed entirely or substitute for another pillow having different stuffing characteristics, as previously described. If a pillow is removed and not replaced, the remaining pillows will maintain their original positions, leaving a soft gap 66 in place of the removed pillow, as shown in FIG. 9. In this region, the body is supported only by the mattress tick 44.

As best shown in FIGS. 7 and 8, the flaps 62 and 64 from adjacent pillows may overlap one another. By adjusting the extent to which the flaps overlap, the separation distance D or width of the space between adjacent pillows may be changed.

Alternatively, the individual pillows could be secured to the inside surfaces of the walls or floor of box 12 with similar kinds of fasteners, so that the pillows are retained in preselected positions and would not move due to a shift in the position of the user or due to removal of one of the pillows.

This construction permits the firmness of a mattress to be easily adjusted according to the needs of an individual. If bedsores develop in the sacral-coccygeal area, for example, a very soft (i.e., low density) pillow or no pillow at all may be preferred in the corresponding region of the mattress. Or, a person with a backache may prefer that the mattress have a different degree of firmness in the "corresponding" area of the mattress, as compared to the remaining areas of the mattress. Later, when the backache disappears, that same person may wish to make the mattress of uniform firmness. All of this can be accomplished by changing, removing or rearranging the pillows within the mattress.

Regardless of whether the pillows are separate (as in FIGS. 5–10) or integrally formed (FIG. 4), they comprise a pillow cushion 16 which can be stuffed into the cushion cavity 22 of the resilient box 12. A cloth case or tick 44 of suitable ticking fabric can be provided to slip over the cushion 16 and box 12, and this can have a suitable closure that permits removal, such as a zipper 42, a VELCRO fasteners, or a hooded flap.

The mattress tick 44 can be made water proof like the pillow bag 30 by choosing a suitably waterproofed woven nylon or polyester cloth, such as the cloth described above in U.S. Pat. No. 4,525,409. If waterproofing is unnecessary, a washable material or tick can be used.

Desirably, the box 12 will be formed from two end sheets 50, two side sheets 52, and a bottom sheet 54 of foam secured together with a suitable adhesive. A preferred foam has a density of $1.9 \pm 0.1$ pounds per cubic foot. A comfortable amount of the pillow stuffing has been found to be 12 pounds of polyester stuffing per pillow bag. The pillow bag 30 is preferably 35 inches by 98 inches (when not filled with stuffing) and has transverse seams placed every 14 inches to form the compartments.

Some of the advantages of the invention, particularly insofar as a reduction in pressure between the mattress and the user's body is concerned, are shown in the following test results. A mattress constructed in accordance with the invention was placed within an ordinary hospital bed frame, which is capable of folding so that the back and head of a patient are elevated if desired. A model 5-235 Talley Skin Pressure Evaluator, marketed by International Medical Equipment Corporation of City of Industry, Calif., was positioned between the body of a person of average build (160–170 pounds) and the inventive mattress. The Evaluators are designed to measure actual pressure between a body surface and a supporting medium in millimeters of mercury (mmHg). Three pressure readings were obtained for each of five important areas of the body and averages. Readings were taken when the body was horizontal (supine) and when the head of the bed was elevated to various degrees from the horizontal. Pressure readings under 38 mmHg are considered excellent by most authorities in the field. With the inventive mattress, the following results were obtained:

PRESSURE READINGS FOR BODY BUILD 160–170 LBS. (AVERAGE BUILD)

| LOCATION OF PRESSURE READING | BODY LOCATION | PRESSURE (mmHg) |
|---|---|---|
| Head | Supine position | 20 |
| Sacral | Supine position | 17 |
| Sacral | Head of bed elevated 20° | 17 |
| Sacral | Head of bed elevated 45° | 4 |
| Sacral | Head of bed elevated 70° | 4 |
| Sacral | Supine position, pillow remove directly under sacral area | 24 |
| Trochanter | Head of bed elevated 45° patient flexed ventrally on side | 18 |
| Trochanter | Head of bed elevated 45° patient flexed dorsally on side | 60 |
| Trochanter | Supine position, cushions separated approximately 3" with Trochanter placed over gap | 38 |
| Scapula | Supine position | 17 |
| Heel | Supine position | 21 |
| Heel | Head of bed elevated 15° | 22 |
| Heel | Head of bed elevated 45° | 23 |
| Heel | Head of bed elevated 50° | 22 |
| Heel | Supine position, pillow removed directly under heel | 9 |

These results show very low pressure readings for virtually every position in which the subjects were oriented on the mattress. Such low pressure readings would, it is believed, substantially contribute to a person's comfort and to the avoidance of bedsores to a bedridden patient.

Those who are skilled in the art will readily perceive how to modify the invention. Therefore, the appended claims are to be construed to cover all equivalent structures which fall within the true scope and spirit of the invention.

The invention claimed is:

1. A mattress comprising:

an open box of firm but resilient material having an upward facing cushion cavity extending substantially the entire length of said box;

a plurality of adjacent individual pillows containing stuffing and disposed in said cushion cavity, each of said pillows having at least two inclined upper surfaces, said inclined surfaces of adjacent pillows defining a space between them;

fastener flaps extending outwardly from each pillow, the flaps of adjacent pillows overlapping one another to form a detachable connection, whereby the body of a user resting on the mattress lies over an alternating series of supporting pillows and spaces without support, and the width of the space between adjacent pillows can be changed by adjusting the extent to which the flaps overlap.

2. The mattress of claim 1 and a ticking extending across said cavity and over said pillows and spaces.

3. The mattress of claim 1 wherein each of said pillows includes means for accessing the interior of the pillow to adjust the type, quantity, or density of stuffing.

4. A mattress comprising a frame of firm and resilient material having sides and a bottom, said frame forming a cushion cavity extending substantially the entire length of said frame;

a plurality of adjacent individual pillows containing stuffing and disposed in said cushion cavity, each of said pillows having at least two inclined upper surfaces, said inclined upper surfaces of adjacent pillows defining a space between them;

flaps of hook and loop type fasteners extending outwardly from each pillow, the flaps of adjacent pillows overlapping one another to form a detachable connection so that the width of the space between adjacent pillows can be changed by adjusting the extent to which the flaps overlap; and a cover extending across said cavity and over said pillows and spaces, so as to provide a resting surface over said pillows and spaces.

5. A mattress for reducing bodily pain including bedsores and back pain, said mattress comprising:

means for defining an outside perimeter of a body-sized mattress in the form of a box having a cavity extending substantially the entire length of said box;

a plurality of adjacent individual body support means substantially filling said box to form a body support surface in said cavity, each of said body support means comprising a cushion extending transversely across substantially the entire width of said cavity; and adjusting means for connecting adjacent ones of said support means to each other in order to adjust the separation distance between them, whereby the body support characteristics of said support means may be adjusted in accordance with the individual and changing needs of the user.

6. The mattress of claim 5 wherein said adjusting means are attached to said individual support means.

7. The mattress of claim 5 including means for adjusting the amount of body support provided by each support means.

8. The mattress of claim 5 wherein each of said support means have sloped surfaces along upper faces thereof so that the sloped surfaces of adjacent support means define a space between them without presenting sharp edges that may cause stress to the user.

9. The mattress of claim 5 wherein there are a plurality of said body support means with different densities, and said body support means are distributed within said box so that said support means are positioned most comfortably relative to the user's body.

10. The mattress of claim 5 wherein said adjusting means comprises a plurality of connecting straps for varying the spacing between said support means, whereby additional spacing may be provided between said body support means to conform to the user's needs.

* * * * *